US006922911B2

(12) United States Patent
Lam

(10) Patent No.: US 6,922,911 B2
(45) Date of Patent: Aug. 2, 2005

(54) CLOTHE DRYING APPARATUS

(76) Inventor: Peter Ar-Fu Lam, 20104 Wayne Ave., Torrance, CA (US) 90503

( * ) Notice: Subject to any disclaimer, the term of this patent is extended or adjusted under 35 U.S.C. 154(b) by 0 days.

(21) Appl. No.: 10/411,817

(22) Filed: Apr. 10, 2003

(65) Prior Publication Data

US 2003/0221333 A1 Dec. 4, 2003

Related U.S. Application Data

(60) Division of application No. 10/339,021, filed on Jan. 8, 2003, and a continuation-in-part of application No. 10/141,434, filed on Jan. 8, 2002, now Pat. No. 6,644,520.

(51) Int. Cl.[7] ..... F26B 9/00
(52) U.S. Cl. ..... 34/239; 34/237
(58) Field of Search ..... 34/239, 209, 210, 34/220, 240, 237; 223/69, 70, 71; 211/85.3

(56) References Cited

U.S. PATENT DOCUMENTS

| | | | | | |
|---|---|---|---|---|---|
| 2,338,776 | A | * | 1/1944 | Miller | 223/67 |
| 2,521,100 | A | * | 9/1950 | Sublette | 223/69 |
| 2,599,199 | A | * | 6/1952 | Roberts | 223/69 |
| 2,854,178 | A | * | 9/1958 | McDowall et al. | 223/69 |
| 3,003,248 | A | * | 10/1961 | Wittie | 34/95 |
| 3,040,903 | A | * | 6/1962 | Crews | 211/119 |
| 3,307,712 | A | * | 3/1967 | Kurz | 211/195 |
| 3,477,155 | A | * | 11/1969 | Feld et al. | 38/102.9 |
| 3,675,338 | A | * | 7/1972 | Maki | 34/239 |
| 3,905,125 | A | * | 9/1975 | Hubner | 34/622 |
| 4,429,928 | A | * | 2/1984 | Sullivan | 312/31 |
| 4,777,737 | A | * | 10/1988 | Wolens et al. | 34/237 |
| 5,440,822 | A | * | 8/1995 | Alpenfels et al. | 34/305 |
| 6,176,400 | B1 | * | 1/2001 | Lam | 223/120 |

FOREIGN PATENT DOCUMENTS

| | | |
|---|---|---|
| DK | 41973 | * 12/1915 |

* cited by examiner

*Primary Examiner*—Kenneth Rinehart

(57) ABSTRACT

A garment drying apparatus (200) is disclosed having a frame (201), a porous net 204, slip proof pads (205,206), an adjustable width garment hanger (202) and a hook (203) to support said adjustable width garment hanger; the frame (201) rests at an acute angle from the floor to provide iron free drying effect.

39 Claims, 13 Drawing Sheets

CLOTHE DRYING APPARATUS

This application is a division of application Ser. No. 10/339,021 filed Jan. 08, 2003 and his a continuation-in-part of Ser. No. 10/041,434 filed Jan. 08, 2002 now U.S. Pat. No. 6,644,520.

FIELD OF THE INVENTION

The present invention relates to an apparatus configured for drying washed cloth naturally.

BACKGROUND OF INVENTION

Delicate garment are hand washed and air-dried. The prior art is replete with various configurations of laundry hangers and drying racks, which dry clothing naturally in the air or under the sun. This is a divisional and continuation in part of applicant's pending U.S. patent application Ser. No. 10/339,021, filed Jan. 8, 2003, and is a continuation of U.S. patent application Ser. No. 10/041,434 filed Jan. 1, 2002, now U.S. Pat. No. 6,644,520 which discloses cloth drying racks structured with a garment hanger to provide droop free and wrinkle free drying effects. Applicant's pending U.S. patent application Ser. No. 10/041,434 also discloses a low cost, moisture resist adjustable garment hanger suitable for drying wet garment and better maintaining the garment shape.

SUMMARY OF THE INVENTION

Used and soiled clothes are mostly cleaned by dry cleaning or by a water washing process. Dry clean clothing in volume is relatively expensive as compared with washing clothing by water. There are also evidences that the traditional dry cleaning process is causing environmental issues. While most clothes are water washed by washing machine and then dried with a heated dryer, the rotational and spinning motions of a washing machine and cloth dryer contribute to a harsh environment that easily damages delicate clothing. In addition, the elevated temperature of a dryer is also causing shrinkage of clothing made by cotton and many other commonly used fabric materials. Accordingly, hand wash and air-drying is still a popular way to clean delicate clothes.

The present invention is directed to an improved garment drying apparatus configured for significantly reducing deformation of the garment caused by traditional air-drying process.

According to one aspect of the present invention, it is provided a supporting frame made of plastic tube or metallic rods. In an exemplary embodiment, four segments of supporting rods are connected end to end to form a square or rectangular frame. The junctions of the rods are designed for fast attachment or release by consumers to transform between a larger size drying mode and a reduced size storage mode. A garment hanger having a medial portion and two supporting arms extending at an obtuse angle from said medial portion is fixedly attached to the central position of the upper rod. Alternately the upper location of the frame is provided a receiving member structured to receive the hook, or the suspension member of a separated garment hanger. This receiving member is positioned around the center location of the upper rim. A sheet of porous material such as a fabric net is stretched and mounted in between the supporting rods. At the bottom of the frame are slip proof pads provided to prevent the frame to skid against the floor. The frame is designed to rest at an acute angle from the supporting floor, within an angular range between 45 degree to 80 degree. In a preferred embodiment, the frame is configured to rest against a wall to provide the resting angle defined. If a supporting wall is not available, other supporting structure is provided behind the supporting frame so that it can rest at an angle from the floor, or a supporting surface.

Washed wet cloth without being squeezed or twisted, is gently hung on a waterproof garment hanger positioned around the upper edge of the frame. Wood hanger is not recommended due to the wet nature of the clothing supported. Metal wire hanger that tends to rust is also not suitable for this application. If the supporting hanger is a separated external hanger, the wet cloth is properly arranged on the hanger before it is attached to the receiving member located at the upper central position of the supporting frame. The next step is to evenly stretch and spread the wet cloth on the surface of the porous supporting sheet. Because of the surface tension provided by the water content of the wet cloth, the wet cloth will adhere firmly to the porous sheet until it is dried. The supporting frame is then rest at an acute angle from a supporting surface, such as a floor or a bathtub. The time required for this natural drying process depends on the relative humidity of the environment, the speed of air movement around and the amount of sunlight available. During the initial period of this natural drying process, water content of the wet cloth starts to cumulate at the bottom portion of the cloth due to gravitational force. When a wet cloth is supported by a regular hanger and air dried as in the traditional drip dry process, the high water content cumulated at the bottom of the cloth creates a high downward pulling force that may damage the fabric of the cloth. This lasting downward pulling force significantly deforms the shape of the cloth after it is dried. When a fixed width garment hanger is used in the traditional drying process, it is impossible for a single hanger to provide a supporting width that always perfectly matches the shoulder dimensions of different clothing sizes. As a result, ugly looking dents caused by the high downward pulling force are found at the shoulder areas of the cloth after it is dried. Accordingly it is another goal of this invention to provide a one stop, deformation free solution for the natural air-drying process.

In order to achieve this goal, a perfect adjustable width garment hanger is provided with the invented dryer frame to form a retail package. The garment hanger is preferred to be adjustable from XS size to XXL sizes, so that clothes of all sized can be dried with the retail package provided. The adjustment mechanism is structured to provide the same amount of extension adjustment to both shoulder arms of the hanger. The preferred adjustment mechanism also allows the hanger to be adjusted to any required supporting width, instead of providing different preset steps of adjustment dimensions. Furthermore, the adjustable hanger is preferred to be adjustable while the wet cloth is put on the hanger.

In a preferred embodiment, the adjustable width garment hanger integrally assembled with the dryer frame, or packaged with the retail kit to form a perfect air-drying solution is equipped with an adjustment mechanism located at the medial portion of the hanger. This mechanism translates the movement of a moving hanger arm located at one side of the hanger, to the moving hanger arm located on the other side of the hanger. Alternatively, the adjustment mechanism is also equipped with an adjustment knob located at the medial portion of the hanger. Both moving hanger arms are moved inward or outward by the same amount when the adjustment knob is turned. These types of adjustment mechanisms are defined as a reciprocal adjustment mechanism in this invention. A reciprocal adjustment mechanism controlled by a centralized adjustment knob has a significant advantage that it allows the supporting width of the drying hanger to be adjusted for a perfect fit after the wet cloth is put on the drying hanger. In a preferred embodiment disclosed in applicant's pending U.S. patent application Ser. No. 10/041,434, two flexible tongues having gears facing in opposite directions are connected to each of the movable supporting arms of the hanger. The gear tongues are then coupled to a gear mechanism that translates the motion of one movable arm to another. An adjustable knob located at the medial portion of the hanger is coupled to one of the adjustment gear so that the hanger width can be adjusted by rotating the adjustment knob.

According to another aspect of the present invention, a thin sheet of porous material is pre-assembled at the factory together with at least one the supporting rods. The porous sheet is then wrap around the bundled supporting rods to form a space saving packaging for retail purpose. In yet another embodiment the porous sheet is folded separately at the factory. Releasable Velcro attachments positioned around the edges of the porous sheet can be provided to facilitate the user to assemble the frame for a drying mode or disassemble the unit to form a smaller size storage mode. The porous sheet is defined as a sheet of material that allows air and water to pass through. Typical examples of porous sheet are nylon net or other porous fabric material suitable for manufacturing laundry accessories. A container is provided at the bottom of the dryer frame to collect the water flowing downward along the porous sheet.

Following is a disclosure of the working principle of this improved drying apparatus that supports the wet cloth at an angle on a porous sheet. During the earlier stage of the drying process, instead of cumulating water at the bottom portion of the cloth, water content of the cloth is directed to the porous sheet and continues its drain along the porous sheet to the container beneath. The porous sheet provides a continuation downward flowing path for the water content that is driven by gravitation force. Drawing the concentration of water content away from the lower portion of the wet cloth significantly reduce the deformation issue and speed up the air-drying process. Since the wet cloth is properly shaped to stick with the porous sheet behind, it is often found that the cloth is in perfect shape and iron free after drying. The inclined angle of the dryer frame is important. If the dryer frame is positioned at 90 degree from the horizontal ground, like a picture frame, the process to direct the water content of the wet cloth to the porous sheet is inefficient. If the dryer frame is positioned completely horizontal, most of the water content of the wet cloth will spread evenly around at the opposite side of the porous sheet and stay there instead of being directed into the collecting container. Therefore the drying time will take much longer. The optimal angle is to have the frame positioned close to 90 degree from the horizontal level but not exactly vertical. Since the addition of the wet cloth to the front side of the support frame shifted the center of gravity of the frame towards the front side, a selection of angle between 45 degree to 80 degree will provide reasonable satisfactory result.

In yet a further embodiment, multiple dryer frames are arranged to be stacked one on top of another so that several clothes can be dried at the same time without occupying too much space. The slip proof bottom pads or the water collection container are shaped to accept multiple dryer frames and keep the space there between. Properly designed spacer is also required at the upper portion to maintain the space between the frames. In an alternate design, the receiving member that receives the hook of the air-drying hanger is shaped to provide the spacer function.

If the drying apparatus is used outdoor, it is important to have the wet cloth firmly attached to the dryer frame so that it will not be blown away by wind. Reliable frame supporting design and/or heavier dummy weight located at the bottom of the drying apparatus are also required to prevent the whole dryer frame to be blown away. In a preferred embodiment to serve this purpose, the suspension member, or the hook of the drying hanger is designed to be in a close loop shape. The suspension member of the hanger is then irremovably attached to the receiving member. At the bottom of the frame two clips are provided to secure the bottom portion of the wet cloth. The clips are attached to the lower portion of the frame either being an integral part of the frame or connected by a string. It should be noted that the embodiments described are exemplary to implement the disclosed theory and different alternate designs can be provided according to the spirit of the invention.

Prior art drying rack was provided with a flexible frame that can be folded into the shape of two circular loops. This prior art design has four characteristics. Firstly the frame is positioned horizontally on top of household bathtub, instead of the inclined angle position, a desirable feature of the subject invention. Secondly, the width of the frame must be approximately equal to the width of household bathtub. Thirdly, the flexible rim of the frame are made with circular shape spring wire of strong spring force so as for the frame to provide adequate supporting force to support the total weight of a wet garment, especially with only two sides of the frame to be supported by the bathtub. Thirdly the top and bottom portions of the frame are in semicircular shape so that the frame can be folded into two circular loops with reasonable force. In order to convert the prior art frame to work with the working principle of the subject invention, several obstacles are identified. Since the surface area of the invented drying rack is substantially larger than the prior art embodiment, folding the frame into three loops is more desirable. Accordingly the spring material is desirable to be made with the softer rectangular section type of metal wire. Although this type of material is capable of folding the frame into a smaller storage mode, the weaker force of the frame is far from adequate to support a wet cloth on any orientation. Another obstacle to overcome is to provide a substantially flat portion at the bottom of the frame so that it is able to stand on a flat surface. Further enhancements include the addition of slip proof means at the bottom of the frame and a suspension member receiver at the top portion of the frame.

As a result of further research of the invention, it was discovered that the weaker rectangular shape of metal spring material and also the bigger surface area helps to provide a reasonable linear width for the frame bottom, so that the frame is able to rest on a floor. However, additional reinforcement structure must be required to support of the frame in the drying mode. This reinforcement structure must also be convertible to provide a smaller size storage mode or retail package. The reinforcement structure must also be easily attached with the flexible frame by the consumers to provide the full size drying mode. According to a further study of the research, a flexible frame with porous sheet of dimension 36 inches by 42 inches are provided so as to comfortable accommodate a large size stretch out long sleeve T-shirt. Four corners of the frame are rounded at a radius of approximately 8 inches so that the bending yield point of the flexible metal spring is not exceeded. The flexible frame is also provided a suspension member receiver around the top central position of the frame. The bottom of the frame is furnished with non-slipping materials. It was further discovered that if the frame is rotated by 90 degree, two petite size clothing can be dried at the same time. Accordingly two additional suspension member receivers are provided at the adjacent side, that is also the longer side of the frame, for receiving two supporting garment hangers. At the opposite side of the frame, one or more additional non-slip member is provided to support the frame. Detachable supporting beam is also provided behind the frame to support the frame and prevent it from collapsing due to the weight of the wet cloth.

In another preferred embodiment the reinforcing supporting beam is divided into multiple segments, which can be connected or folded from a smaller storage mode into a rigid larger operation mode. In another embodiment, a tripod or easel type of reinforcing supporting structure is provided to serve two purposes at the same time. The first function is to reinforce the strength the strength of the frame to support wet heavy cloth. The second purpose is to enable the frame to stand on the ground without resting against a wall. The reinforcing supporting structure may comprise telescopic segments, foldable segments or connectable segments for transforming the structure between the smaller size storage mode and the larger size drying mode. The reinforcing supporting structure is also structured to attach with the drying rack from the ground level all the way to the top of the frame. The top point of the supporting attachment is preferred to be close to the location of the garment hanger hook receiver, that defines the heaviest loading point of the frame.

A very useful characteristic of a tripod shape reinforcement structure is discovered during the invention research. The height of the attachment point can be adjusted according to the angle of the tripod. The steeper is the angle of the tripod, the higher is the attachment point. This characteristic is particularly useful when two different drying modes—the single larger size garment drying mode and the dual petite garment drying mode are required to be supported by the same reinforcement supporting structure. In the situation of the dual garment drying mode, both the angle and the height of the tripod may be adjusted such that the two suspension member receivers of the frame are in a position to be attached with the supporting beams of the tripod.

During the winter season or in the regions of the country where humidity is high, temperature is low or sunlight is rare, there is a desire to speedily drying the garment indoor. Accordingly other embodiments are provided to provide a heat source or a force air ventilation facility around the drying rack to speed up the drying process. Another preferred embodiment integrated the heat source with the reinforcement supporting structure. The beam or pipe that forms the supporting structure is circulated with heated liquid, or lined with resistive electricity to heat converting elements. On another preferred embodiment, a durable rigid frame embedded with heating element such as an electricity to heat converter is provided to serve the drying process.

The indoor versions of the invented embodiment offer a positive side effect during dry season and wintertime. The drying process improves the humidity of the house. In another preferred embodiment, a specially shaped water-collecting podium beneath the drying rack is provided for the drying rack to rest upon the floor outlet of a house heater. The hot air provided by the external house heater speed up the drying process while the humidity of the heated air is improved. In another preferred embodiment, force air ventilator or build in heater is provided beneath the drying rack to improve dry air circulation or to provide heat energy that helps to speed up the drying process. The force air ventilator can be integrated with a filter to provide air cleaner filtering function, another feature welcome by most homes especially during the allergy season. During wintertime, alternate heating source may be provided by radiation from a hot surface instead of forced hot air.

In another preferred embodiment, multiple drying racks arranged parallel to each other are contained inside an enclosure together with the force air ventilation facility, dust filter and/or heat generation source. A slide tray is preferred such that the array of the drying racks can be removed from the enclosure for easy assessment.

In order to further enhance the iron free goal of drying process, a suitable solvent is to be provided during the washing process to help relaxing the fiber of the garment so a to provide a smoother feeling of the garment after it is dried. Alternately, another type of solvent may be used during the washing process to help maintaining the fiber shape of the garment so as to provide a starched and ironed effect after the garment is dried.

From the foregoing, an invention is disclosed to provide a retail kit of universal drying apparatus to perfectly dry delicate clothes of different sizes and to provide near iron free effect to the dried garment. The novel features of the invention are set forth with particularity in the appended claims. The invention will be best understood from the following description when read in conjunction with the accompanying drawings.

DESCRIPTION OF THE PREFERRED EMBODIMENTS

Figure 1:
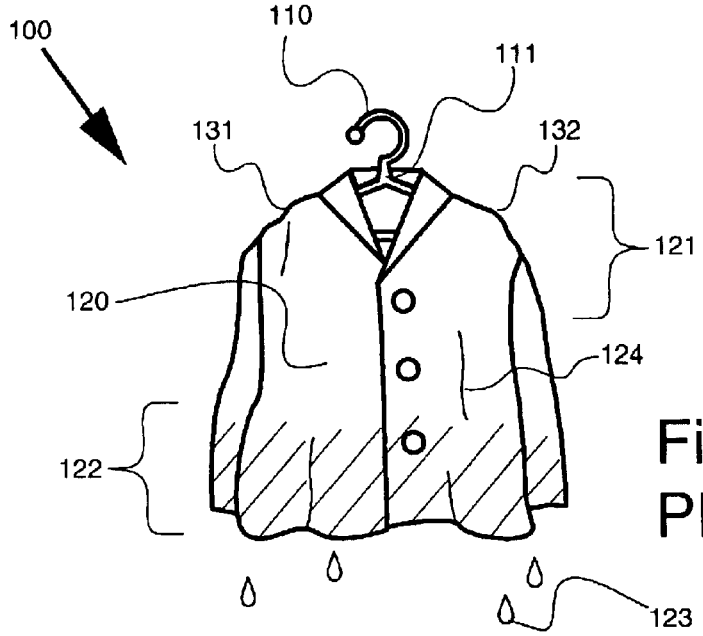
Figure 1 PRIOR ART
FIG. 1 illustrated prior art method of drying delicate clothing by a traditional garment hanger.

FIG. 1 is the front view of a prior art air-drying set up. A standard size hanger 111 supports a wet cloth 120 for air dry. The wet cloth 120 is made of delicate material such as wool or knitwear. In order to avoid unnecessary wrinkling, the wet cloth 120 is not squeezed or twisted before the air-dry process. During the first early stage of the drying process, water content of the wet cloth is drawn to the lower portion 122 of the cloth by gravitational force. Excess water that exceeds the surface tension of water becomes droplets 123 and fall to the ground. At a second early stage of the air-drying process, no more water is able to become droplets. The drying process is now relying on evaporation. During this stage, the lower portion 122 of the wet cloth 120 is still soaked with water content absorbed by the fabric. This stage will last for several hours until the water content is fully evaporated. The rich water content cumulated at the lower portion of the wet cloth creates a heavy downward pulling force for an extended time. This pulling force not only pulls the wet cloth into a longer vertical shape, it also creates vertical wrinkle lines 124 to the cloth. Standard size hangers 111 are used for most of the households during the traditional air-drying process. The high downward pulling force is particularly harmful to the shoulder portion of a wet cloth due to three reasons. Firstly, the hand wash and air-drying process is applied mostly to clothes made of delicate materials. These materials have a much higher tendency to suffer from significant deformation damage when being supported by a hanger of improper size and then pulled downward with a heavy force for an extended time. Secondly, most fabric materials tend to be soft and easy to reshape when it is wet. The shape is then set when a wet cloth becomes dry. Therefore the dent mark is particularly significant and difficult to recover after the air-drying process. Thirdly, the hanger supports only the shoulder portion of the wet cloth. All the weight of the wet cloth including the heavy water content beneath becomes pulling force concentrated along this shoulder line for an extended time. It is the objective of this invention to provide a perfect air drying apparatus that works with clothes of different sizes and eliminate all the draw backs of the traditional air-drying set up without scarifying the drying time.

Figure 2A:
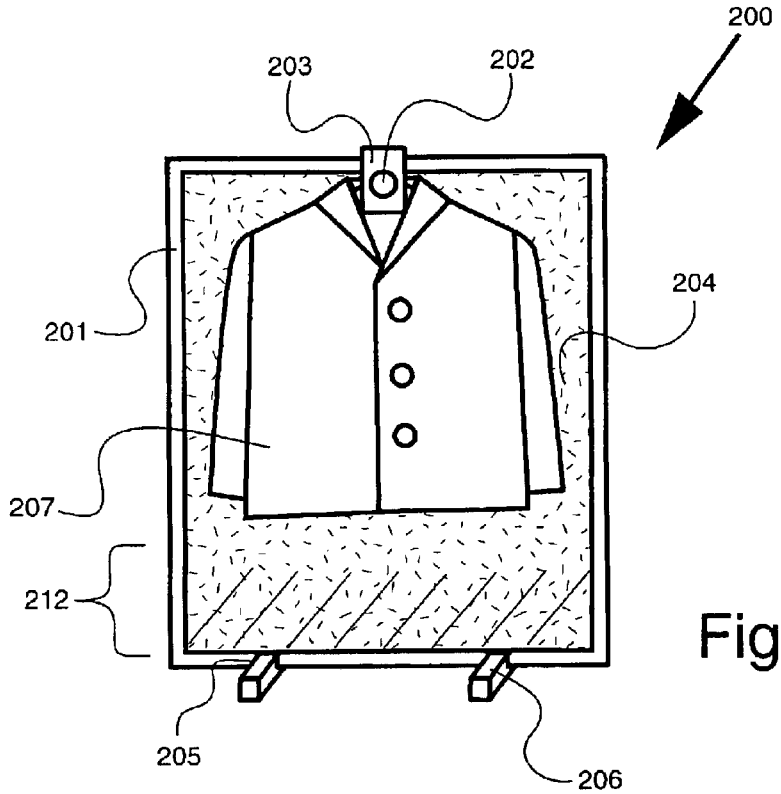
FIG. 2A is a front view to illustrate a preferred embodiment of the subject invention with a wet garment properly arranged on the porous drying sheet.
Figure 2B:
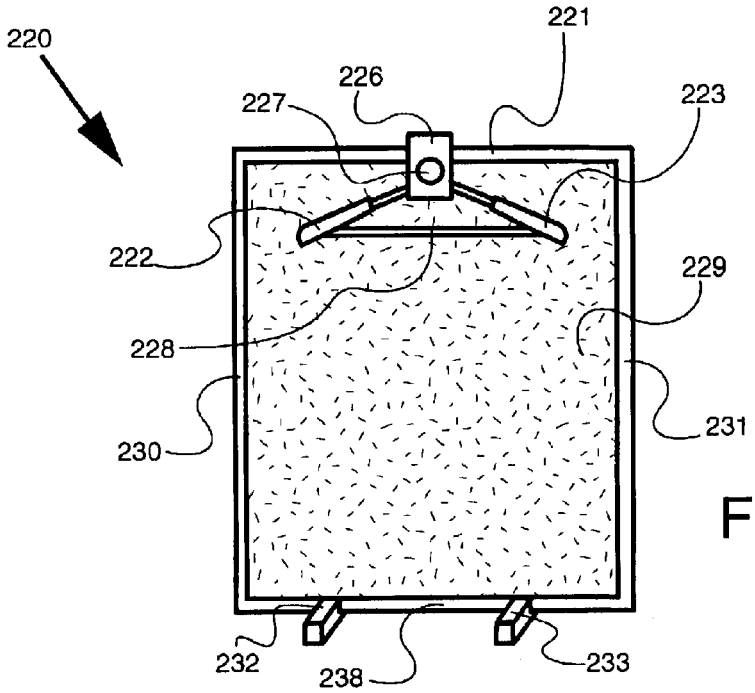
FIG. 2B illustrates the front view of the embodiment shown in FIG. 2A without the garment.
Figure 2C:
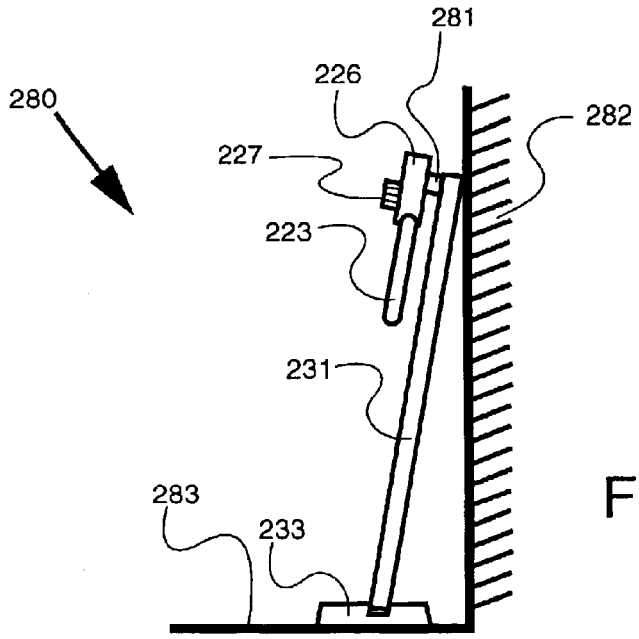
FIG. 2C illustrates the side view of the embodiment shown in FIG. 2B.

FIG. 2A illustrates an improved apparatus 200 provided for air-drying a wet cloth 207. The air-drying apparatus comprises a frame 201, which supports a thin porous sheet 204. At the top of the frame 201 is an adjustable hanger 203 extended from the upper edge of the frame 201. A knob 202 is provided to adjust the supporting shoulder width of the hanger in order for it to perfectly support the wet cloth 207. At the bottom of the frame 201 are the slip proof pads 205 and 206. FIG. 2B illustrates the embodiment of FIG. 2A without the wet clothe attached. FIG. 2C illustrates the side view of the embodiment shown in FIG. 2B. It can be observed that the medial portion 226 of the adjustable hanger extends from the upper rod 221 of the dryer frame. Beneath the medial portion are the adjustable moving arms 222 and 223 that travel along the supporting arms of triangular hanger frame 228. The knob 227 is coupled with the internal mechanism that adjusts the position of the moving arms 222 and 223. A receiving portion 281 is provided to assemble the hanger 228 with the upper portion 221 of the frame and providing a room between the frame and the hanger for the wet cloth to be put in.

Figure 3:
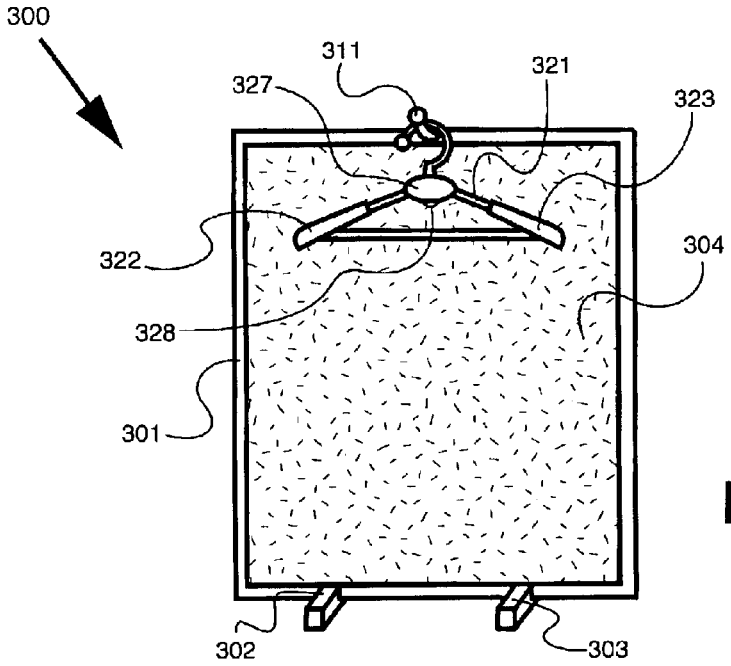
FIG. 3 illustrates the components included in a retail packaging of the subject invention as a total solution to address the problems faced by the traditional air-dry set up.

FIG. 3 demonstrates an alternate embodiment 300 that provides a receiving means 311 extended from the upper edge of the dryer frame. This receiving means accepts the suspension member of the adjustable hanger 321 that is sold separately as an option, or packaged with the dryer frame 301 to provide a one stop, total solution for a universal garment air-drying apparatus that is ready to perfectly dry clothes of different sizes.

Figure 8A:
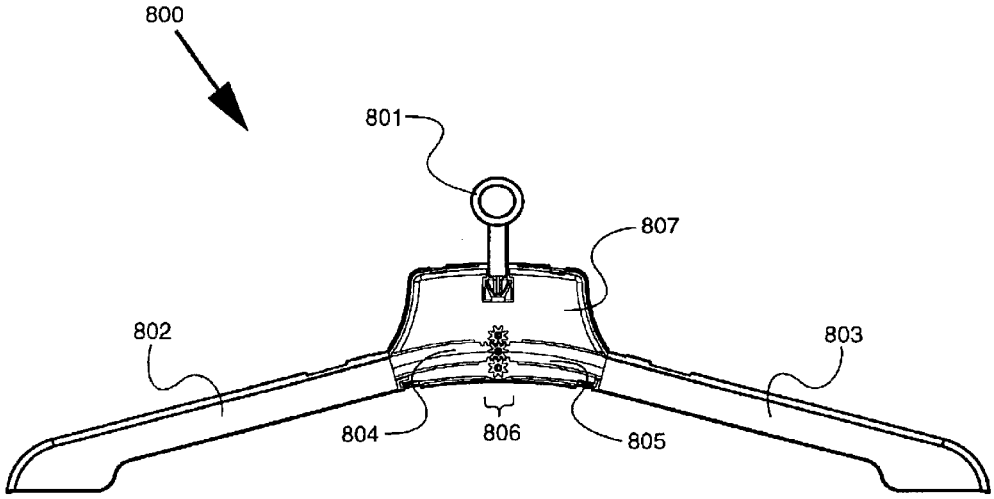
FIG. 8A illustrated an adjustable width garment hanger specially designed to become a member of the drying apparatus retail package invented.
Figure 8B:
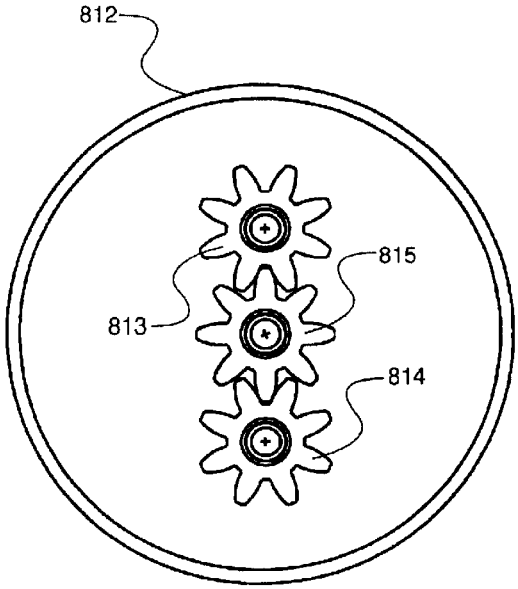
FIG. 8B illustrates the adjustment knob assembly of the adjustable hanger disclosed in FIG. 8A.
Figure 8C:
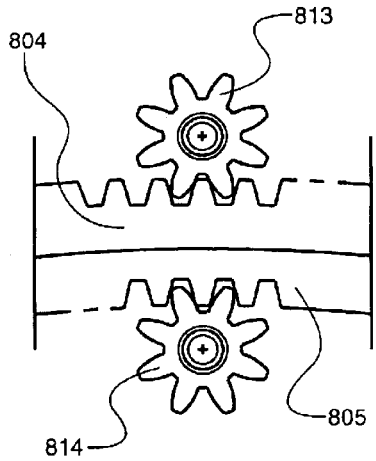
FIG. 8C illustrates the internal working structure of the hanger width adjustment mechanism illustrated in the embodiment of FIG. 8A.

The garment hanger 321 comprises a triangular frame and two movable arms 322 and 323 located at the two sides of the hanger. Beneath the medial portion 327 of the adjustable hanger 321 is a manual adjustment knob 328 that adjusts the movement of the moving arms 322 and 323. The location of the adjustment knob 328 enables the movable arms 322 and 323 of the hanger to be adjusted even when a wet cloth is placed onto the hanger 321. Attention is now directed to FIGS. 8A to 8C, which illustrate the detail mechanical structure of a reciprocal adjustable hanger equipped with an adjustment knob located at the medial location. The hanger 800 comprises a special ring shape suspension member 801, a medial portion 807, two moving arms 802, 803 and a central reciprocal adjustment mechanism 806. The linkage tongues 804 and 805 are connected to the movable arms 802 and 803 respectively. When the upper linkage tongue 804 is moved by pushing the movable arm 802, the motion is translated to the gear 813 as shown in the enlarged FIG. 8C. FIG. 8B illustrates the adjustment gear chain 806 located behind the linkage tongues. It can be observed that the motion of the gear 813 is translated to the central gear 815 and then to the bottom gear 814. Movement of the gear 814 will cause the linkage tongue 805 to drive the movable arm 803 to expand or contract by the same amount. The adjustment knob 812, accessible from the outside of the hanger medial portion, is coupled to the gear 815. This adjustment knob, also represented by the knob 328 as shown in FIG. 3 will move the gears 813, 814 when it is turned. The motion is then transferred to the movable arms 802 and 803 at the same time.

Figure 4:
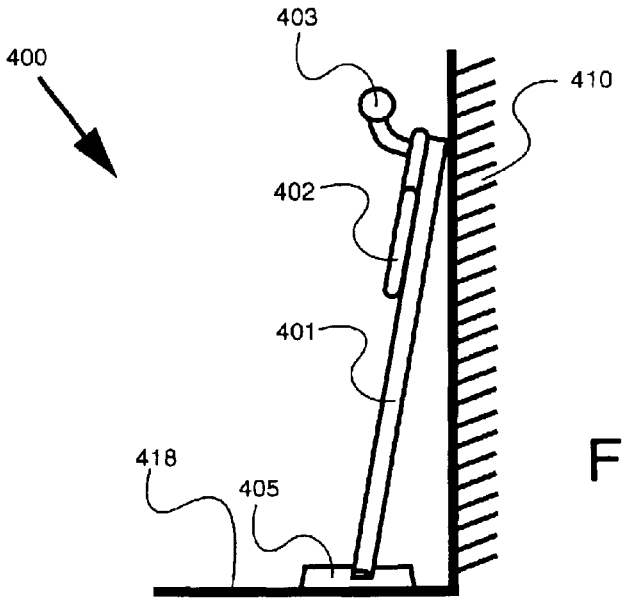
FIG. 4 is a side view of the embodiment shown in FIG. 3.

Attention is now directed to FIG. 4 that shows the side view of the embodiment shown in FIG. 3. The frame 401 is positioned at an angle around 70 degree from the floor 418 and rests against a wall 410. The slip proof pad 405 prevents the frame 401 from slipping along the floor 418.

Figure 5A:
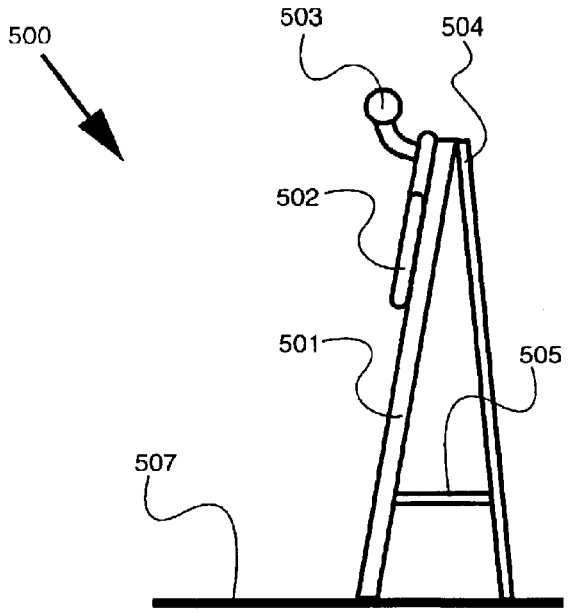
FIG. 5A illustrated an alternate embodiment to support the dryer frame at an acute angle from the floor.
Figure 5B:
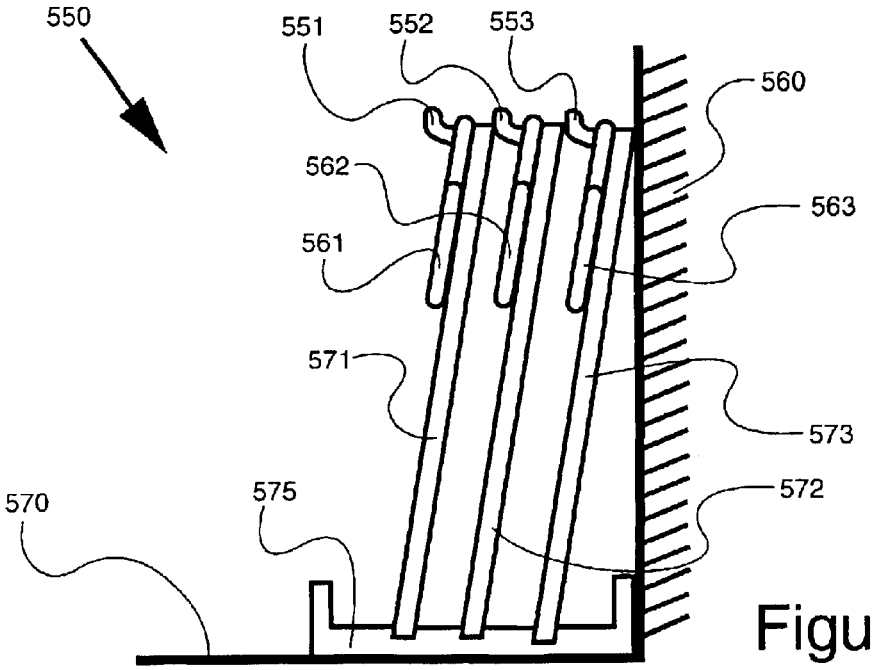
FIG. 5B illustrated a space saving embodiment to air-dry several clothing at a time.

FIG. 5A discloses an alternate structure of the air-drying apparatus that is supported by the rods 504 and 505 instead of resting against a wall. FIG. 5B illustrates an improved set up that allows three supporting frames 571, 572 and 573 to be positioned one in front of another. The container 575 serves two purposes. Firstly it collects water droplets guided by the porous sheets of the three supporting frames. Secondly, it provides slip proof grooves to support the frames. Thirdly, the grooves define the separation distances between the three supporting frames 571 to 573. The upper portion of the supporting frames 571 to 573 are maintained in position separated from each other by the receiving members 551 to 553.

Figure 9A:
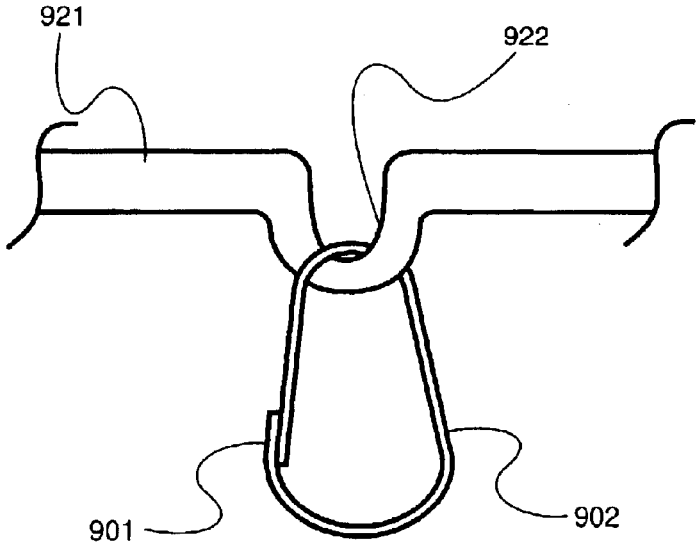
FIG. 9A illustrates the embodiment of a secure receiving member to accept the hook of the hanger disclosed in FIG. 8A.
Figure 9B:
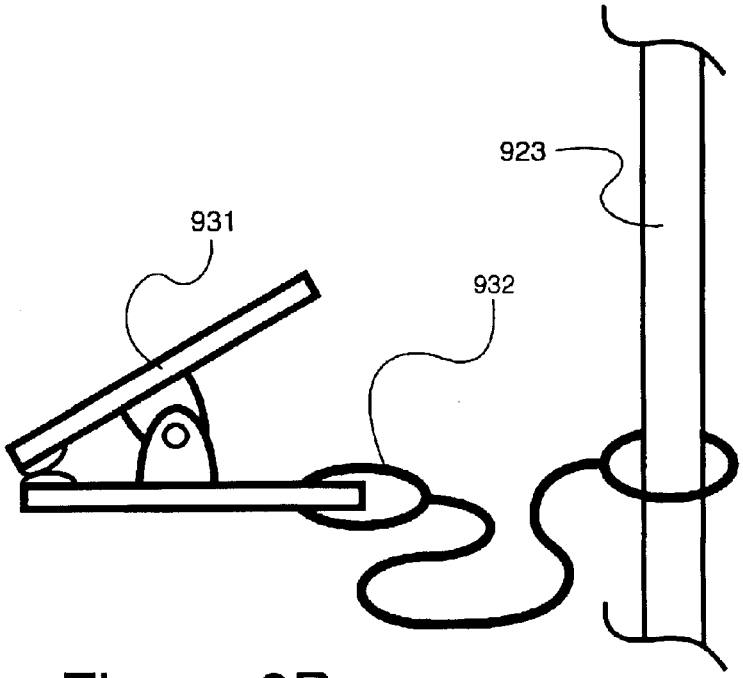
FIG. 9B illustrates example of clip design provided at the bottom region of the supporting frame for securing the lower corner positions of the cloth resting on the drying apparatus.

Attention is now directed to FIG. 9A, which represents an alternative arrangement of the receiving member located at the upper central portion of the supporting frame. The upper horizontal rod 921 of the frame 301 as shown in FIG. 3 is provided a notch 922 at the central position. This notch is an alternative design to represent the receiving means of the frame to accept the hook of a garment hanger. Assembled to the notch 922 is an attachment device 902 having a spring releasable opening 901. The purpose of the attachment device is to securely retain the suspension member of the garment hanger used with the air-drying apparatus. When the close loop suspension member 801 of the specialty garment hanger illustrated in FIG. 8A is engaged with the secure attachment device 902, the releasable opening 901 is closed to a locked position to prevent the garment hanger to be removed unintentionally, such as in a windy situation. The suspension member 801 can be removed only when releasable opening 901 is manually opened. It should be noted that an adjustable hanger integrally assembled with the hanger frame as shown in FIGS. 2B and 2C not only serves the secure attachment purpose described, it also prevents the user from picking any other standard size hanger to use with the dryer frame. This is a foolproof set up that prevents the shoulder portion of a drying garment to be deformed. An alternate method to provide a fool proof design is to modify the structure of the embodiment demonstrated in FIGS. 2B and 2C such that the adjustable hanger 228 can be released and reconnected by a special receiving means 281. Because there is no hook provided for the hanger 228, users will not try to remove the adjustable hanger 228 sold with the package. The special close loop suspension member 801 illustrated in FIG. 8A is also capable to serve the same foolproof purpose. To further prevent the drying cloth being blown away by the wind, retainer clips 931 are provides as shown in FIG. 9B. Gripping means represented by two clips are also provided to keep the bottom corners of the cloth in position. The retainer clips 931 are either integrally formed with the supporting frame or attached to the frame by a string 932.

Figure 6:
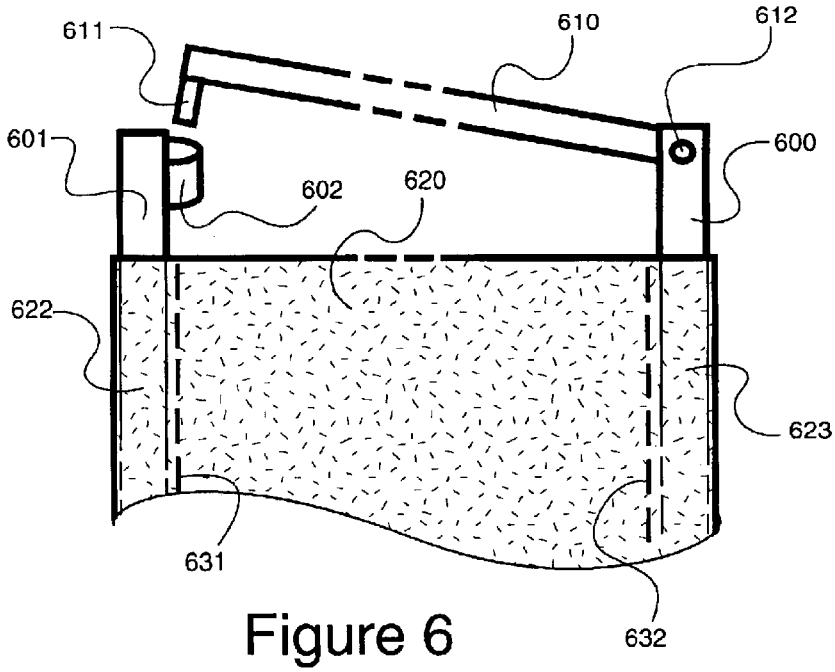
FIG. 6 demonstrates how segments of the dryer frame are connected to transform from a relaxed storage mode into a stretched dying mode.
Figure 7:
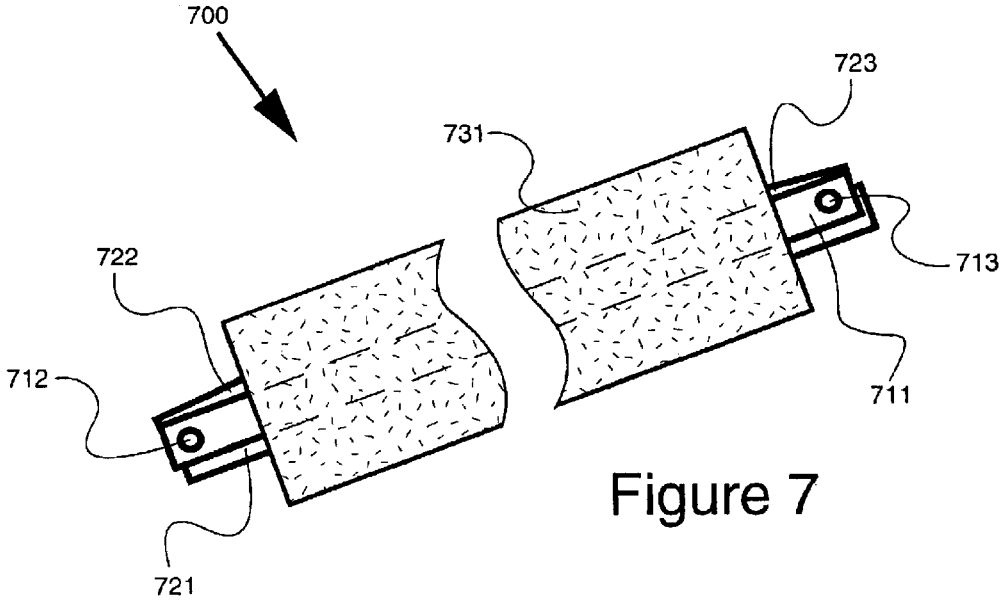
FIG. 7 demonstrates the storage mode of embodiment shown in FIG. 6.

In order to have a drying area adequate to support most lady size garments, the dimension of the garment drying apparatus is recommended not to be less than 20 inches in width and 30 inches in height. A reasonable dimension chosen for household use is 30 inch by 36 inches, up to 36 inches by 42 inches for the air-drying apparatus to work with clothes size ranges from XS to XXL sizes. It is another goal of the subject invention to provide an air-drying apparatus that can be easily folded by users to form a smaller size storage mode and expanded by users to provide a larger size drying mode. FIG. 6 illustrates a porous sheet pre-assembled with the supporting rods 600 and 601 at the factory. The horizontal supporting rod 610 is hinged with the vertical right hand side rod 612. When the air-drying apparatus is in use, the upper horizontal rod 610 is connected between the vertical rods 600 and 601. The catch 602 of the vertical supporting rod 601 accepts the pin 611 of the horizontal rod 620. Upper edge of the porous sheet can be attached to the upper horizontal rod 610 by Velcro attachments. The bottom supporting rod is assembled to form the supporting frame in the same manner. When the air-drying apparatus is not in use, the horizontal rods 722, 723 are released and folded with the vertical rods 711, 721 as shown in FIG. 7. The relaxed porous sheet 731 is then wrapped around the bundled rods to form a small size storage mode. It should be noted that the embodiments illustrated are exemplary and there are many different ways to form the expanded size drying mode and reduced size storage mode. All these different ways are considered to be within the scope of this invention as allowed by the appended claims.

Figure 10A:
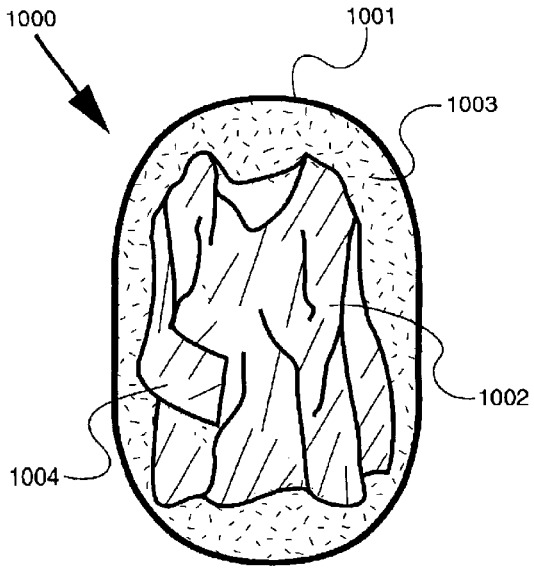
Figure 10A PRIOR ART
FIG. 10A illustrates a prior art drying tray having a semicircular top and bottom.
Figure 10B:
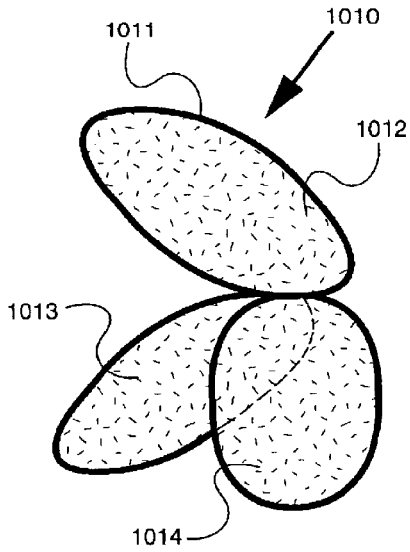
FIG. 10B illustrates the folded mode of the prior art dryer tray of FIG. 10A.
Figure 10C:
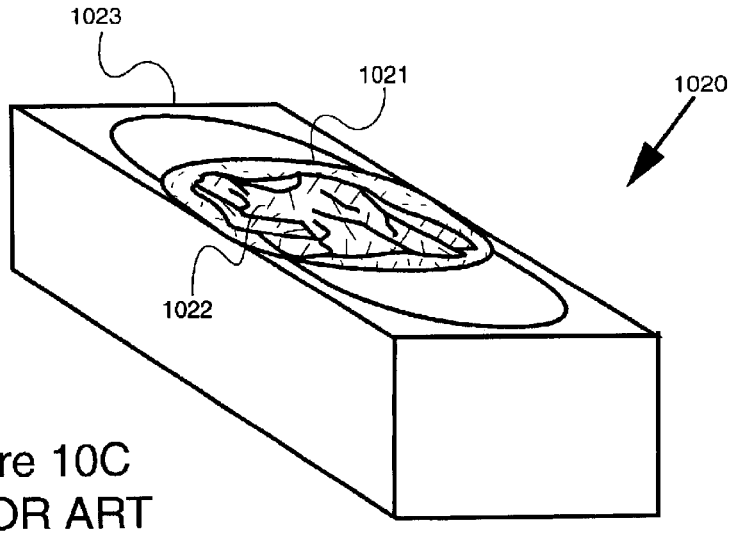
Figure 10C PRIOR ART
FIG. 10C demonstrates the application condition of the prior art dryer tray positioned on top of a bathtub.

FIG. 10A illustrates a prior art drying rack. FIG. 10C demonstrates how the prior art drying rack rests on a bathtub. This drying rack is designed to rest on household bathtubs. Accordingly the width of the rack is of a consistent dimension around 26 inches. This dimension is critical to the prior art as if the width is too narrow, the drying rack cannot rest on the bathtub. If the width is too wide, the drying rack will interfere with some bathtub slide doors. In addition, the portion of the wet cloth extending beyond the bathtub will drip water to the floor of the bathroom. Because of the size limitation, a regular size garment cannot be completely stretched out on the prior art drying rack. Accordingly, the garment is squeezed within the peripheral of the drying rack as illustrated on FIG. 10A. Actually, this picture is also illustrated in the prior art packaging. The horizontal position of the drying rack also slows down the drying process. Water content of the wet cloth concentrates at the underneath portion of the garment and the supporting net facing the bathtub. Air ventilation at this region is poor. The rim of the prior art drying rack is filled with a circular shape metallic spring wire. The circular shape spring wire gives extremely strong spring force that is adequate to support the weight of a wet cloth across the bathtub. However, the circular shape spring wire has a limitation, that it allows the frame to be folded into two circular loops instead of three loops as allowed by the weaker rectangular shape spring wire. The semicircular top and bottom portions of the prior art drying rack help the frame to be folded into two circular loops. Another limitation of the prior art drying rack is that the design tailored with the bathtub prohibited the apparatus to be used outdoor under sunlight. This is critical as our research result comparing the drying time of the prior art drying rack inside a bathroom is 12 times longer as compared with the invented drying rack rest against a wall under the sun in the yard on the same day.

Figure 11A:
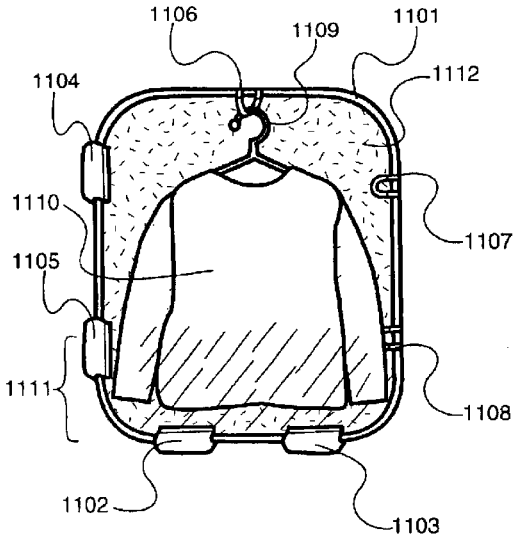
FIG. 11A is an alternate embodiment of the invented dryer frame having a foldable flexible rim.

Because of the substantially larger size of the drying rack invented, it is more desirable for the drying rack to be folded into three loops if a flexible dryer frame is utilized. Accordingly the weaker rectangular section type of spring wire is desirable. FIG. 10B illustrates a flexible frame to be folded into three loops with this type of weaker spring wire. An embodiment making use of the flexible frame is illustrated in FIG. 11A. The rim of the frame 1101 is embedded with the weaker rectangular section type of spring wire. The porous sheet 1112 is stretched by the flexible rim 1101 when the frame is deployed. At the top of the frame is a suspension receiving member 1106 which receives the hook member 1109 of a garment hanger. At the bottom of the frame are the anti-slip members 1102 and 1103 which prevents the dryer frame from skidding when rest at an angle against a wall. It should be noted that the number and shape of anti-slip members are exemplary. Different designs and materials are considered to be within the scope of this claimed invention. The wet garment 1110 supported by the hanger 1109 is carefully stretched on the frame without any wrinkle to provide a near iron free drying effect. Since the dryer frame is in a near vertical position, water content of the garment is attracted by the gravitational force to the bottom portion of the frame as shown in the 1111 region of FIG. 11A. Along one longer neighboring side of the frame are two additional suspension member receivers 1107 and 1108. These receivers are provided to receive two smaller width hangers when the frame is converted into another drying mode by rotating the frame 90 degrees. On the other side of the frame are two additional anti-slip members 1104 and 1105 provided to support the frame when it is in the alternate drying mode. Each corner of the frame are curved to a radius such that the spring wire embedded inside the rim of the frame does not exceed it's elastic yield point.

Figure 11B:
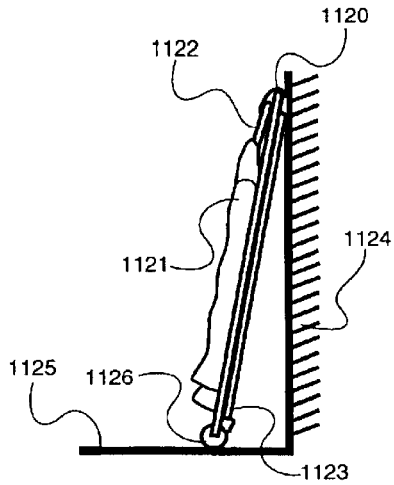
FIG. 11B is the side view of FIG. 11A showing a supporting beam behind the garment supporting frame.
Figure 11C:
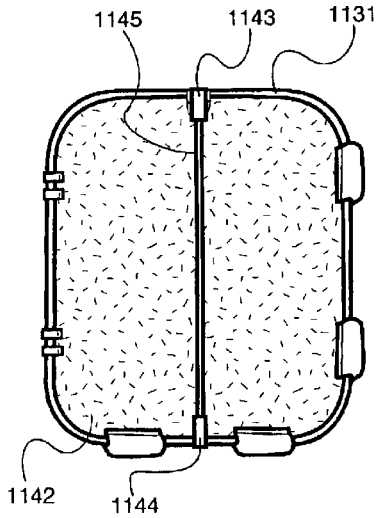
FIG. 11C illustrates the rear view of FIG. 11A demonstrating a solid supporting beam positioned to support the receiving member located at the top of the dryer frame.

Attention is now directed to FIG. 11B, which illustrates a supporting beam 1123 provided as a reinforcing supporting structure of the dryer frame. FIG. 11C illustrates the rear view of the dryer frame. The separate supporting beam 1145 is received by the attachments 1143 and 1144 located around the central positions of the top and bottom rims. It means the supporting beam is positioned to support the suspension member receiver 1106, where the maximum loading point locates. It should be noted that the beam supporting can be of different material and different cross sectional shape as long as it is able to provide adequate supporting strength to the frame.

Figure 11D:
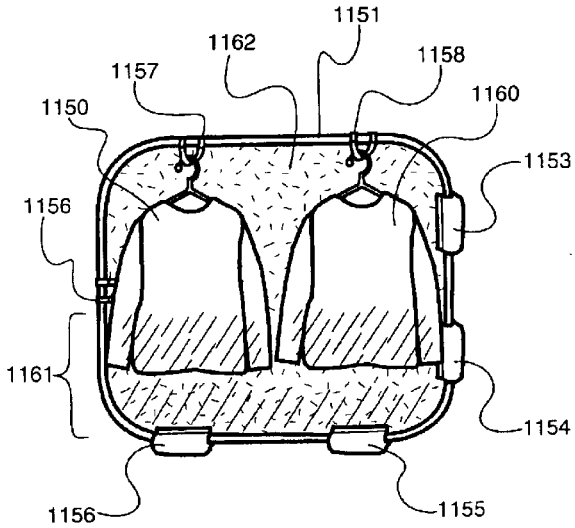
FIG. 11D demonstrates an alternate application mode of the dryer frame of FIG. 11A for supporting two smaller size garments.

FIG. 11D illustrates the frame of FIG. 11A rotated by 90 degrees. The suspension member receivers 1157 and 1158 support two smaller clothing 1150, 1160 and their smaller size garment hangers. These receivers are positioned approximately one quarter length from their respective corners. From here it can be observed that the supporting garments should be of adjustable width so as to provide precise, perfect width to support the smaller garments of FIG. 11D and the larger garment 1110 of FIG. 11A to avoid shoulder droops, dents and wrinkles after the drying process.

Figure 12A:
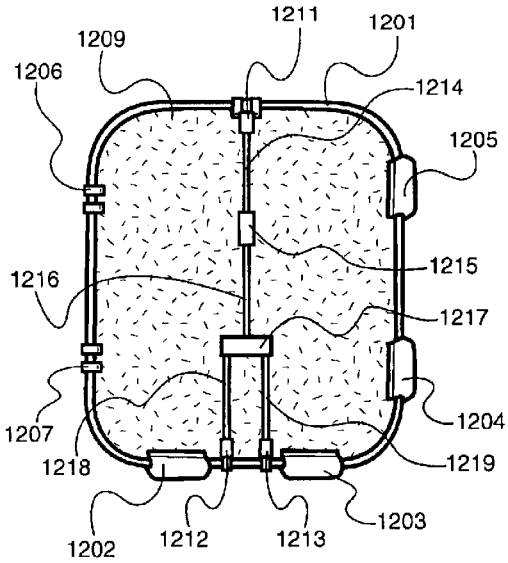
FIG. 12A is an alternate embodiment of FIG. 11D illustrating a foldable supporting structure comprising more than one supporting beams.
Figure 12C:
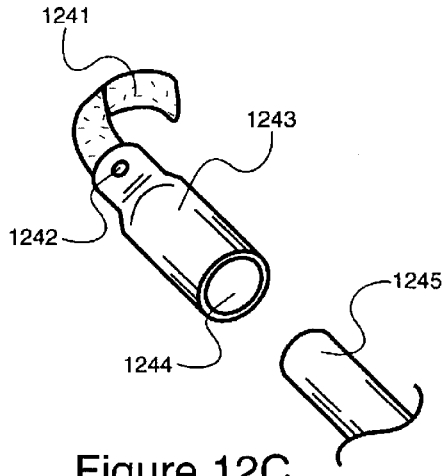
FIG. 12C demonstrates a receiver provided to receive a terminal end of the supporting beam.

FIG. 12C illustrates how the terminal of the beam 1245 is inserted into an attachment receiver 1243 during the assembly or disassembly process of the frame. The attachment receiver is connected to a fabric section 1241, which is sewn to the rim of the dryer frame.

Figure 12B:
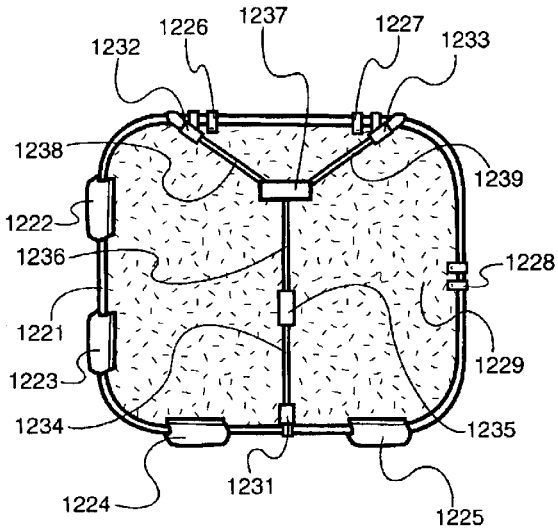
FIG. 12B illustrates an alternate configuration of the supporting structure to support the flexible frame of FIG. 11C.
Figure 12D:
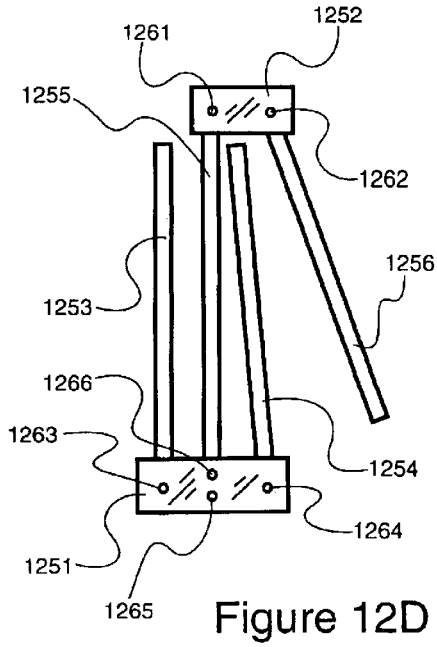
FIG. 12D illustrates the supporting structure comprising four supporting beams before it is assembled to support the dryer frame of FIG. 12A and FIG. 12B.

FIG. 12D illustrates an alternate reinforcement supporting structure made of four beams 1253, 1254, 1255 to 1256. The beams are connected together by the brackets 1251 and 1252. The pivot points 1261 to 1266 enable the beams to be reconfigured to support the dryer frame in different application modes, and to be folded for the smaller size storage mode. FIG. 12A illustrates a first application mode to support a larger single clothing as illustrated in FIG. 11A. The segment 1214 is received by the attachment receiver 1211 positioned behind the suspension member receiver 1106 of FIG. 11A. The beam segments 1218 and 1219 are connected to the bottom rim of the frame by the receivers 1212 and 1213. When two smaller garments are to be dried, the dryer frame is rotated by 90 degrees. The beam segments 1238 and 1239 are connected to the top rim of the frame as illustrated in FIG. 12B, at the regions close to the suspension member receivers 1157 and 1158 of FIG. 11D. Accordingly a configurable reinforcement supporting structure is disclosed to provide a small size storage mode and to support different enlarged modes of drying operations. It should be noted that different methods to reconfigure the shape of the reinforcement supporting structure includes but not limited to telescopic connections, detachable connections, rotatable, foldable and hinged connections. All these different methods are embraced by the claims of the subject invention.

Figure 13A:
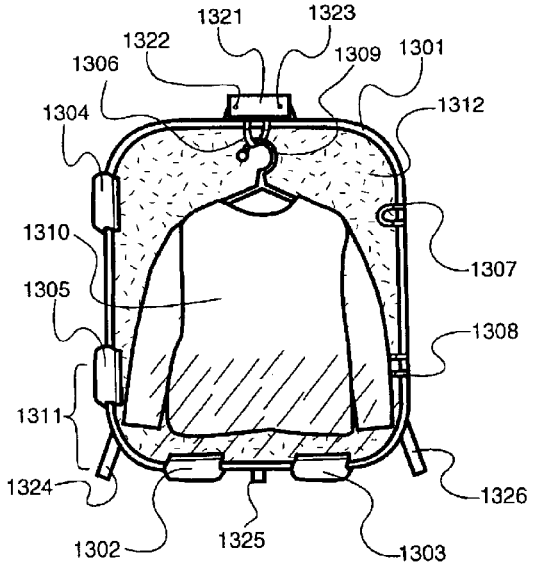
FIG. 13A demonstrated an alternate embodiment of the supporting beam assembly.
Figure 13B:
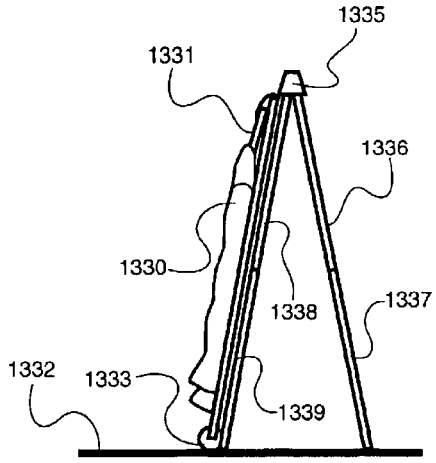
FIG. 13B illustrates the side view of FIG. 13A.

FIG. 13A illustrated an alternate reinforcement supporting structure in the shape of a tripod or an easel enabling the dryer frame to stand independently at an acute angle from the ground. Behind the top central rim of the frame, an attachment design such as Velcro or button are provided to connect the frame with the tripod 1321. The two supporting beams 1324 and 1326 of the tripod extend from the top rim of the frame all the way to the lower portion of the dryer frame. Attachments designs may also be provided to secure the lower side of the dryer frame with the supporting beams 1324 and 1326 of the tripod. FIG. 13B illustrated the side view of the FIG. 13A. The frame rests against the supporting beam segments 1338, 1339 at an angle from the ground. It is also desirable for the tripod to be shrunk to a smaller size storage mode by means of folding, detachable connection or telescopic designs. According to the demonstration in FIG. 13B, the tripod are formed by the beam segments pairs 1336, 1337 and 1338, 1339 connected end to end together.

Figure 14A:
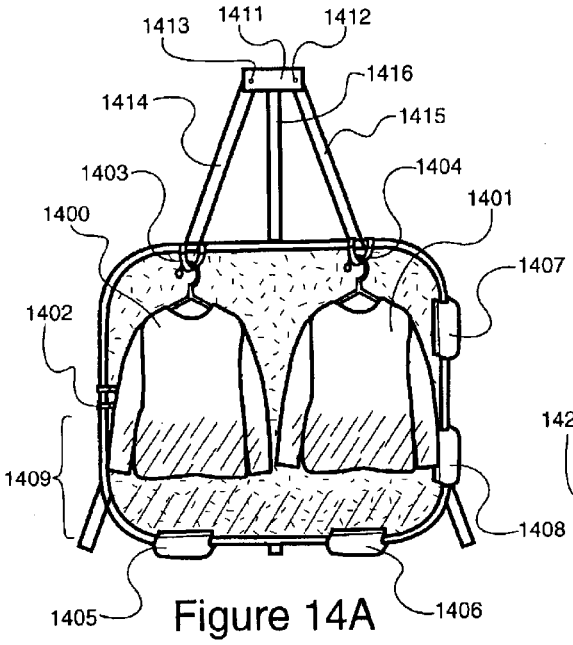
FIG. 14A demonstrated an alternate drying mode modified from the assembly of FIG. 13A.
Figure 14B:
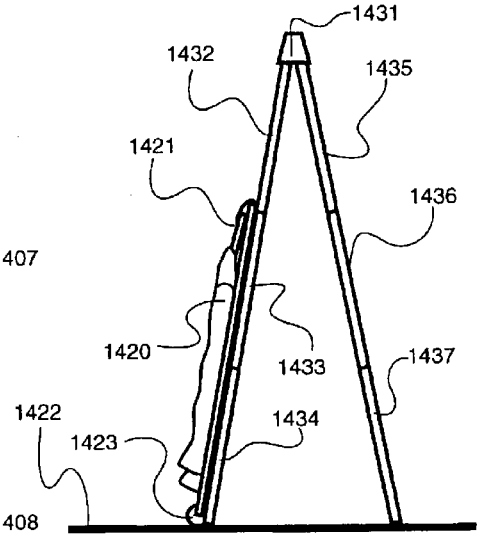
FIG. 14B illustrates the side view of FIG. 14A.

FIGS. 14A and 14B illustrate how the tripod is reconfigured to support the dryer frame when it is rotated by 90 degrees for drying two smaller garments. It is important for the tripod to extend from the upper rim of the dryer frame from the locations proximate to the suspension member receivers 1403 and 1404. The tripod can be lengthened by a telescopic or folding process. In FIG. 14B three beam segments are connected to provide a longer supporting height. The angle between the beams 1414 and 1415 can also be adjusted so that these supporting beams cross over the attachment area proximate to the suspension member receivers 1403 and 1404. It can be observed that the principle of this reinforcement supporting structure is different when compared with traditional applications of tripod and easel where the camera, signs or picture frame are placed near the top portion of the tripod. In this application, the tripod provides a loading supporting point near the top rim of the dryer frame and the support extends all the way to the ground level such that the drying frame is able to securely rest at an angle from the ground.

Figure 15:
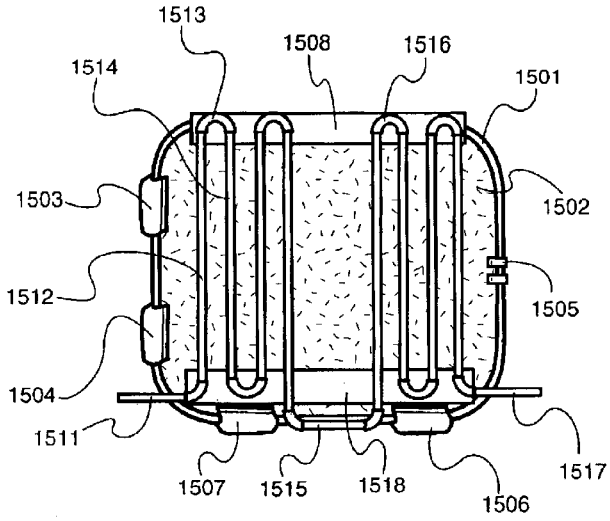
FIG. 15 illustrates an alternate embodiment having a heated supporting structure located behind the dryer frame of FIG. 11C.

It is another objective of the invention to provide a dryer frame that works in wintertime, and also in regions of high humidity and inadequate sunlight. For the drying rack to be effectively used indoor, a heat source is provided near by the inclined drying rack. FIG. 15 illustrates a preferred embodiment showing supporting beams 1512, 1514 supporting the dryer frame at an angle from the ground. The supporting beams are hollow metallic pipes interconnected by the U shape connectors 1513. Hot water, hot oil or other kinds of hot liquid are pumped to circulate through the supporting beams 1512, 1514 to help speeding up the drying process. Alternately, resistive electricity to heat converters can be provided inside the supporting structure for helping the drying the process. The design is particularly useful for drying clothes during wintertime as the dryer itself serves the purpose of a heater. The evaporated water content from the wet cloth also helps to increase the indoor humidity during the dry winter season.

Figure 17A:
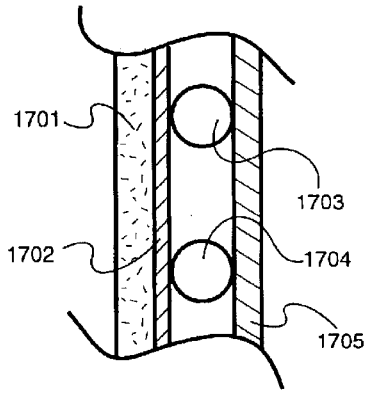
FIG. 17A demonstrates the sectional view of the dryer frame illustrated in FIG. 16.
Figure 16:
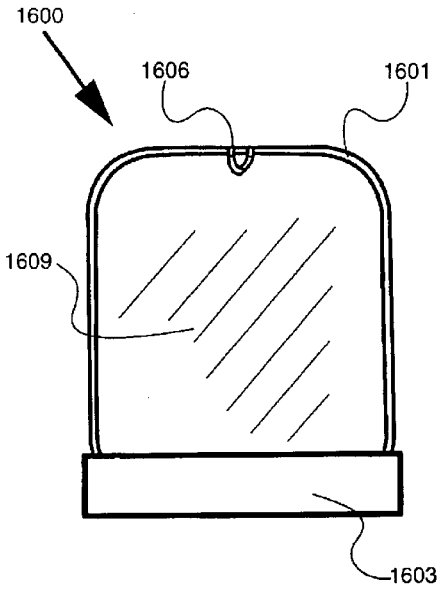
FIG. 16 illustrated a rigid supporting frame embedded with a heat source.
Figure 17B:
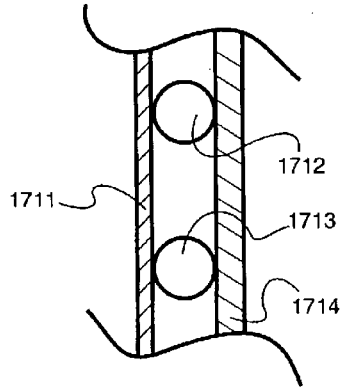
FIG. 17B demonstrates the sectional view of an alternate embodiment of the dryer frame illustrated in FIG. 16.

FIG. 16 illustrates an alternate embodiment having the heat source completely embedded inside a solid frame. The frame 1600 is normally an indoor heater having a heat radiating surface 1609. The device can be positioned vertically when it is used as a heater. When the device is used as a garment dryer, a mechanism is provided to tilt the embodiment 1600 such that it is around 70 degree from the ground. A wet garment supported by an adjustable hanger is attached to the receiver 1606. At the bottom of the device is a water collector 1603. The surface 1609 should be made of heat conductive and rust resist material. This surface can be decorated with graphics to enhance the appeal. The porous layer on top of the frame is now optional. FIGS. 17A and 17B illustrates the sectional view of the heating panel. The heat source 1703, 1704, 1712 and 1713 provide heat energy to the heat conductive surface of 1702 or 1711. The layer 1701 of FIG. 17A represents the porous layer which helps to draw the water content away from the wet clothing and direct the water to the water collector 1603 of FIG. 16. The rear layer of the panel 1705 and 1714 should be made of heat isolator material such that all the heat generated will be dissipated to the front side that helps to dry the wet clothing.

Figure 18A:
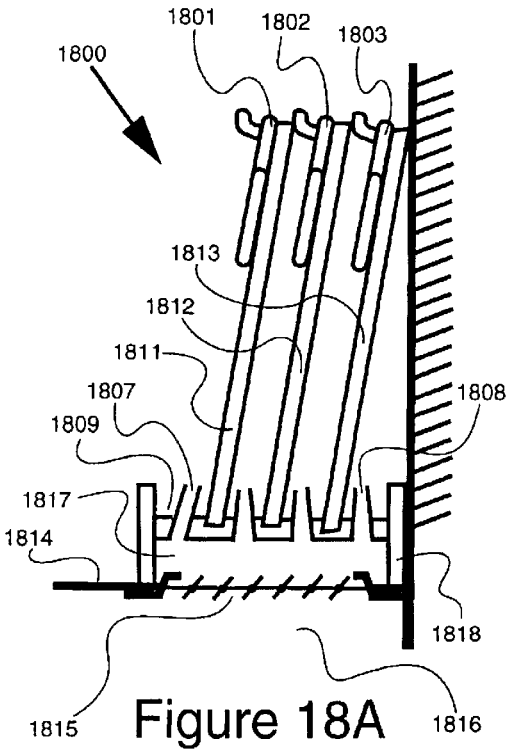
FIG. 18A demonstrates the side sectional view of an alternate preferred embodiment making use of a floor mounted house heater to speed up drying the garments supported on the dryer frames.

FIG. 18A illustrates another preferred embodiment improved from that of FIG. 5B. The water collector 1818 is provided with a bottom cavity 1817 to cover a heating outlet 1815 mounted on the floor 1814. The hot air blow out from the heater is directed to the drying surface of the drying racks 1811 to 1813 by the nozzles 1807 to 1808. Dripped water is collected in the cavity 1809. This device makes use of traditional floor mounted house heater to improve the wet cloth drying speed and also increase the indoor relative humidity during wintertime.

Figure 18B:
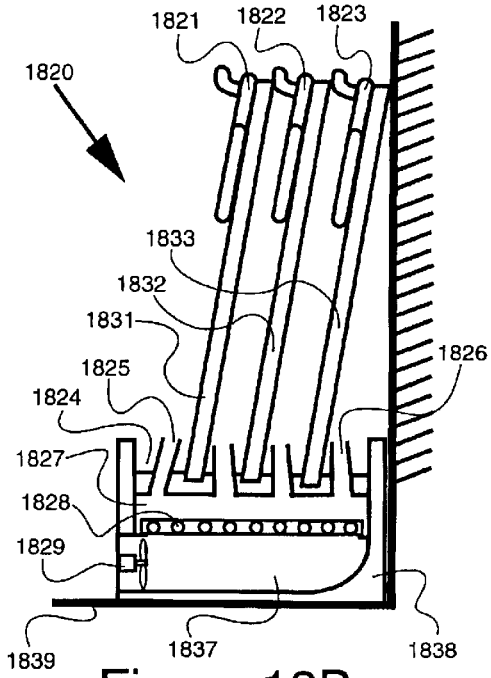
FIG. 18B demonstrates the side sectional view of another preferred embodiment making use of a force air ventilator to speed up drying the garments supported on the dryer frames.

In the situation a floor mount heater is not available, the bottom portion of the water collector 1818 of FIG. 18A can be modified to include a force air ventilator, a force air heater or a combination thereof. FIG. 18B demonstrates the improvement of FIG. 18A to provide a force air ventilator. The fan 1829 intakes air from the room and blows the air through the nozzle 1825, 1826 to improve the drying speed. Heating element may be provided on the layer 1828 to convert the device into a force air heater and cloth dryer combination. Alternately, the layer 1828 can be replaced with a dust filter such that the device 1838 becomes an air filter and clothing dryer combo.

Figure 19:
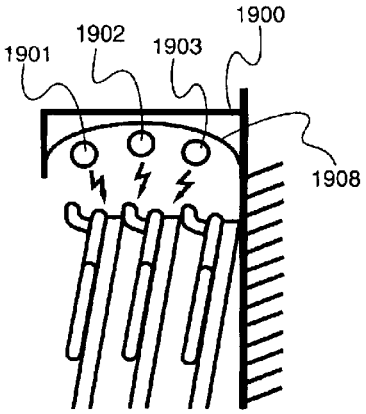
FIG. 19 illustrates a side sectional view of a top mounted heat radiator configured to speed up drying the garments supported on the dryer frames.

FIG. 19 illustrates another embodiment having heat energy radiated from hot surfaces represented by the heater tubes 1901 to 1903. The reflector 1908 enhances the heat radiation efficiency. The hot tubes may be arranged at different locations around the drying rack.

Figure 20:
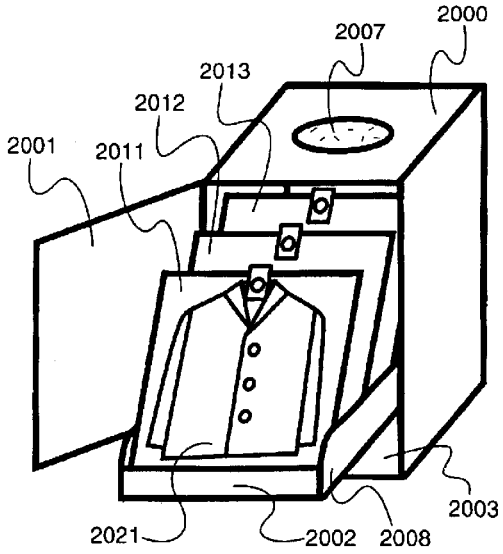
FIG. 20 illustrates a structure for multiple dryer frames to be contained in an enclosure equipped with a slide tray and a force air ventilator.

In order to improve the visual appearance and drying efficiency of the device illustrated in FIG. 18B, an enclosure is provided to surround the garment under drying as demonstrated in FIG. 20. This design helps to conserve the heat energy or dry air to better stay around the drying surface. The water collecting tray is preferred to be in the shape of a slidable drawer which allow the drying racks to be pulled outside the enclosure to facilitate clothing loading and unloading. On top of the tray are the dryer frames 2011 to 2013, which rest at an acute angle from the ground level and parallel to each other. When force air ventilation or force heat source are utilized, exhaust air outlet is provided as shown in the ventilation hole 2007 of FIG. 20.

From the foregoing it should now be recognized that embodiments of a retail kit of air-drying apparatus have been disclosed herein especially suited for eliminating the common problems encountered by the traditional air-drying process. All essential components required to support clothes of different sizes are provided in this total solution air-drying kit. Heat source and/or force ventilation device are added in further embodiments to help speeding up the drying process.

What is claimed is:

1. A cloth drying apparatus comprising:

a variable size flexible frame structured to provide an expanded size drying mode and a reduced size storage mode said frame has a top portion, a bottom portion, and a top side; said frame is also structured to rest at an acute angle from a supporting surface during said expanded size drying mode wherein the top one third region and the bottom one third region of said frame in this position are defined as the upper portion and the bottom portion respectively;

at least one receiving means located proximate to the upper portion of said frame to receive a garment hanger supporting a seperate garment to be dried;

a porous sheet structured to be stretched by said frame in said expanded size drying mode for further supporting said garment; said frame is further structured to release said porous sheet from the stretched condition of said expanded size drying mode when said cloth drying apparatus is converted into said reduced size storage mode; and supporting structure comprising at least one beam extending from the upper portion of said frame to support said expanded size drying mode.

2. The cloth drying apparatus of claim 1 wherein said supporting structure is connected to the bottom portion of said frame.

3. The cloth drying apparatus of claim 1 wherein one receiving means is provided at a first side of said frame and two additional receiving means are provided at a second side adjacent to said first side of the frame.

4. The cloth drying apparatus of claim 1 further comprising two or more beams to provide the expanded size drying mode.

5. The cloth drying apparatus of claim 4 wherein said beams are configured to support said frame in a first drying mode having a first side of said frame positioned to be the top side of the frame; said beams are further configured to support said frame in a second drying mode when a second side of said frame adjacent to said first side is positioned to be the top side of the frame.

6. The cloth drying apparatus of claim 1 further comprising a heat source located behind said frame.

7. The cloth drying apparatus of claim 6 wherein said heat source comprises a pipe structured to allow heated liquid to flow through the pipe.

8. The cloth drying apparatus of claim 6 wherein said heat source comprises an electricity to heat energy converter.

9. The cloth drying apparatus of claim 6 wherein said heat source drives hot and/or dry air to flow through the surface of said frame during said expanded size drying mode.

10. The cloth drying apparatus of claim 9 wherein said heat source comprises an external house heater.

11. A retail package configured for forming a cloth drying apparatus includes:

a variable size frame structured to provide an expanded size drying mode and a reduced size storage mode said frame has a top portion, and a bottom portion; said frame is also structured to rest at an acute angle from a supporting surface during said expanded size drying mode wherein the top one third region and the bottom one third region of said frame in this position are defined as the upper portion and the bottom portion respectively;

said frame further provides at least one receiving means located at the upper portion of said frame to receive a seperate garment hanger supporting a garment to be dried;

a porous sheet structured to be stretched by said frame in said expanded size drying mode; and supporting means comprising at least one beam extending from the upper portion of said frame to support said frame during said expanded size drying mode.

12. The retail package of claim 11 further comprising a garment hanger having a medial portion and two supporting arms extending in opposite direction at an obtuse angle from said medial portion.

13. The retail package of claim 12 wherein said garment hanger comprises a reciprocal adjustment mechanism configured to adjust the width of said garment hanger.

14. The retail package of claim 11 wherein said supporting means extends from a location proximate to said receiving means when said cloth drying apparatus is assembled.

15. The retail package of claim 11 wherein said supporting means supports said frame in a first position; and said supporting means is further configured to support said frame in a second position orientation defined by rotating said frame ninety degree from said first position orientation.

16. A cloth drying apparatus comprising:

a variable size frame structured to provide an expanded size drying mode and a reduced size storage mode; said frame is also structured to stand at an acute angle from a supporting surface during said expanded size drying mode;

a porous sheet structured to be stretched by said frame for providing said expanded size drying mode; said sheet is also configured to be wrapped with said frame or folded to provide said reduced size storage mode;

at least one receiving means located at the upper portion of said frame to receive a seperate garment hanger supporting a garment to be dried; and slip prevention means located at the bottom rim of said frame.

17. The cloth drying apparatus of claim 16 wherein one receiving means is provided at a first side of said frame and two receiving means are provided at a second side adjacent to said first side of said frame.

18. A cloth drying apparatus comprising:

a frame structured to stand at an acute angle from a supporting surface;

at least one receiving means located at the upper portion of said frame to receive a seperate garment hanger supporting a garment to be dried and drying means comprising at least one of the following drying structures for providing a drying mode:

(1) a heat source structured for heating said frame or a garment supported on said frame; and (2) force air ventilation means for forcing air movement around said frame or a garment supported on said frame.

19. The cloth drying apparatus of claim 18 wherein said heat source comprises a pipe structured to allow heated liquid to flow through the pipe.

20. The cloth drying apparatus of claim 18 wherein said heat source comprises an electricity to heat energy converter.

21. The cloth drying apparatus of claim 18 wherein said heat source drives hot and/or dry air to flow through the surface of said frame.

22. The cloth drying apparatus of claim 21 wherein said heat source is provided by a house heater.

23. The cloth drying apparatus of claim 18 further comprising a second frame positioned in a position approximately parallel from said first frame.

24. The cloth drying apparatus of claim 18 wherein said first and second frame are contained in an enclosure during said drying mode.

25. A cloth drying apparatus comprising:

a first frame comprising first receiving means extending from the upper rim of said first frame to receive a first garment hanger supporting a first garment to be dried;

a second frame positioned in a position approximately parallel from said first frame; said second frame comprises second receiving means extending from the upper rim of said second frame to receive a second garment hanger supporting a second garment to be dried wherein each of said frames comprises a porous sheet dimensioned for further supporting said first and second garments.

26. The cloth drying apparatus of claim 25 wherein each of said frame is supported at an acute angle from a supporting surface.

27. The cloth drying apparatus of claim 25 further comprising at least one of the following drying structures for supporting a drying mode:

(1) a heat source structured for heating said frame or a garment supported on said frame; and (2) force air ventilation means for forcing air movement around said frame or a garment supported on said frame.

28. The cloth drying apparatus of claim 27 wherein said heat source comprises a pipe structured to allow heated liquid to flow through the pipe.

29. The cloth drying apparatus of claim 25 wherein said heat source comprises an electricity to heat energy converter.

30. The cloth drying apparatus of claim 25 wherein said heat source drives hot and/or dry air to flow through the surface of said frame.

31. The cloth drying apparatus of claim 30 wherein said heat source comprises a house heater.

32. The cloth drying apparatus of claim 25 wherein said first and second frame are contained in an enclosure during said drying mode.

33. A cloth drying apparatus comprising:

a frame structured to stand at an acute angle from a supporting surface;

at least one receiving means located at the upper portion of said frame to receive a seperate garment hanger supporting a garment to be dried and water collection means positioned for collecting water flowing down from said frame.

34. The cloth drying apparatus of claim 32 further comprising at least one of the following drying structures for providing a drying mode:

(1) a heat source structured for heating said frame or a garment supported on said frame; and (2) force air ventilation means for forcing air movement around said frame or a garment supported on said frame.

35. A method to clean and dry a garment comprising the steps of:

1. providing a frame having at least one receiving means located at the upper portion of said frame for attaching said frame with a garment hanger; said frame is further provided a porous sheet filling the central portion of said frame;
2. providing structural means to support the frame of step 1 to rest at an acute angle from a supporting surface;
3. washing a garment and arranging said washed garment on a garment hanger while said garment is wet;
4. engaging the garment hanger of step 3 with the receiving means of step 1; and
5. arranging the wet garment to smoothly layout on the porous sheet of said frame.

36. The method of claim 35 to clean and dry a garment further comprising a step to arrange the structure of said frame for providing a smaller size storage mode and an expanded size drying mode.

37. The method of claim 35 further comprising a step to provide a solvent during the washing process of step 3 to help smooth out said garment during the later drying process.

38. The method of claim 35 further comprising a step to provide a solvent during the washing process of step 3 to enhance the iron free drying effect for said garment.

39. The method of claim 35 further comprising a step to provide a heat source and/or a force air ventilation means to enhance the drying process of said garment.

* * * * *